United States Patent [19]

Tholander

[11] Patent Number: 4,607,668

[45] Date of Patent: Aug. 26, 1986

[54] WEFT YARN STORING, FEEDING AND MEASURING DEVICE FOR JET WEAVING MACHINES

[75] Inventor: Lars H. G. Tholander, Huskvarna, Sweden

[73] Assignee: Aktiebolaget IRO, Ulricehamn, Sweden

[21] Appl. No.: 641,898

[22] PCT Filed: Dec. 12, 1983

[86] PCT No.: PCT/SE83/00448

§ 371 Date: Aug. 8, 1984

§ 102(e) Date: Aug. 8, 1984

[87] PCT Pub. No.: WO84/02362

PCT Pub. Date: Jun. 21, 1984

[30] Foreign Application Priority Data

Dec. 10, 1982 [SE] Sweden ..... 8207096

[51] Int. Cl.[4] ..... D03D 47/36; B65H 51/00

[52] U.S. Cl. ..... 139/452; 242/47.01

[58] Field of Search ..... 139/452, 370.2, 116; 242/47.01, 47.12, 47.13

[56] References Cited

U.S. PATENT DOCUMENTS

| | | | |
|---|---|---|---|
| 4,270,579 | 6/1981 | Nakanishi | 139/370.2 |
| 4,407,336 | 10/1983 | Steiner | 139/452 |
| 4,415,008 | 11/1983 | Keller et al. | 139/370.2 |
| 4,458,726 | 7/1984 | Wenig | 139/11 |
| 4,458,729 | 7/1984 | Brouwer | 139/452 |
| 4,527,598 | 7/1985 | Walch | 139/370.2 |

FOREIGN PATENT DOCUMENTS

| | | | |
|---|---|---|---|
| 889255 | 12/1981 | Belgium . | |
| 889677 | 1/1982 | Belgium . | |
| 3123760 | 2/1982 | Fed. Rep. of Germany . | |
| 3140561 | 7/1982 | Fed. Rep. of Germany . | |
| 2508501 | 12/1982 | France | 139/452 |
| 8304056 | 11/1983 | World Int. Prop. O. | 139/452 |
| 2065726 | 7/1981 | United Kingdom . | |

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

This device has a storage drum (2) onto which an intermediate weft yarn store can be wound by a winding-on member (3) and from which the weft yarn (WY) is withdrawn spiralling around the withdrawal end of the storage drum, at least one yarn stopping device (10/14) being arranged at said withdrawal end and consisting of a stopping element (14) and of actuator means (11) moving said stopping element into and out of the path of the yarn being withdrawn, and an actuator control unit (B) transmitting an actuating signal to said stopping device when a weft yarn length corresponding to the length of the shed (WMS) of woven fabric in the machine has been withdrawn from the storage drum. The actuator control unit (B) is electrically connected to a yarn sensing detector (WD), preferably of optical type and known per se, positioned at the arrival end (AE) of the shed (WMS) for the weft yarn (WY) at a predetermined distance (d) from said arrival end. Thus, the control unit (B) receives an electric signal when the inserted weft yarn (WY) reaches the yarn sensing detector (WD) and in response thereto generates and transmits the actuating signal to the actuator means (11) of said yarn stopping devices for stopping the withdrawal of the weft yarn from the storage drum (2).

3 Claims, 7 Drawing Figures

WY
B
SWD

WEFT YARN STORING, FEEDING AND MEASURING DEVICE FOR JET WEAVING MACHINES

The present invention relates to a weft yarn storing, feeding and measuring device for jet weaving machines, having a storage drum onto which an intermediate yarn store can be wound by a winding-on member, and from which the yarn is withdrawn spiralling around the withdrawal end of the storage drum for insertion into the shed of a jet weaving machine, at least one yarn stopping device being arranged at said withdrawal end and consisting of a stopping element and of actuator means moving said stopping element into and out of the path of the yarn being withdrawn, and an actuator control unit transmitting an actuating signal to said stopping device when a desired yarn length, adjustable in the device, has been withdrawn from the storage drum.

A known device of this kind is disclosed in the Belgium Pat. Nos. 889 255 and 889 677 (corresponding to the international patent application No. PCT/BE 82/00011).

The object of the present invention is to further increase the certainty in the prior art devices of this kind that the yarn stopping device really is actuated for stopping the yarn withdrawal in due time, i.e. in such a way that the stopping element is moved into the path of the yarn being withdrawn before the yarn withdrawal point passes the position of this stopping element and travels another withdrawal revolution around the storage drum before it is stopped by said stopping element, which latter case would mean that the inserted weft yarn would erroneously have an additional length corresponding to the circumference of the storage drum.

This object is achieved in accordance with the invention in that said actuator control unit is electrically connected to a yarn sensing detector, preferably of optical type and known per se, which is positioned at the arrival end of the shed for the weft yarn at a predetermined distance from the selvedge of the fabric being woven, said control unit thereby receiving an electric signal when the inserted weft yarn reaches the detection area of said yarn sensing detector and in response thereto generating and transmitting said actuation signal to the actuator means of said yarn stopping device for stopping the withdrawal of the weft yarn from the storage drum.

A preferred embodiment of a yarn storing, feeding and measuring device in accordance with the present invention will now be described in detail with reference to the enclosed drawings, where FIG. 1 shows schematically the weft yarn insertion means of a weaving machine of air jet type, comprising a yarn storing, feeding and measuring device according to the invention;

Figure 1:
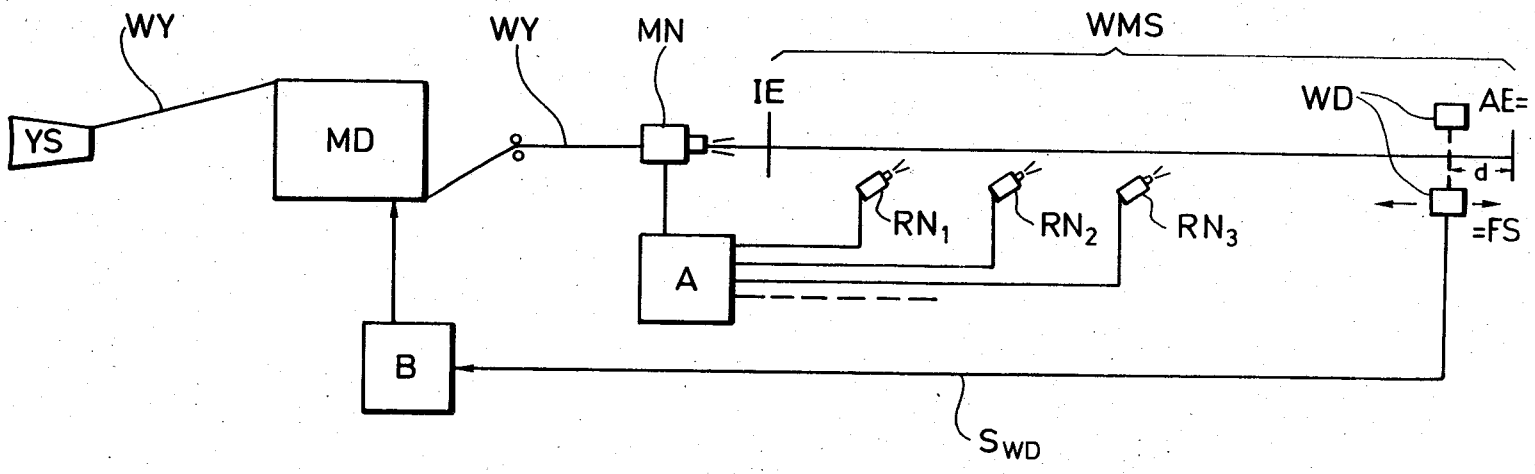

Referring now to FIG. 1, a weft yarn WY coming from a yarn spool YS is wound onto a yarn storing, feeding and measuring device MD, which will be described below in detail with reference to FIGS. 2–5. The weft yarn WY is inserted once per weaving cycle into the shed WMS of a weaving machine of the air-jet type, well-known to the man skilled in the art, by means of actuating (opening) an air jet main nozzle MN positioned just outside the insertion end IE of the shed. The opening and closing of the nozzle MN is controlled from a first electronic control unit A, which unit also controls the opening and closing of a plurality of so called air jet relay nozzles RN1–RNn (where n can be e.g. equal to sixteen), which support the transport of the weft yarn WY up to the arrival and AE of the shed. Main nozzle and relay nozzle control systems for jet weaving machines are for example disclosed in DE-OS No. 28 36 206, as well as in Applicant's U.S. application Ser. No. 641,899 as filed on the same day as the present application, now U.S. Pat. No. 4,541,462.

In accordance with the present invention, a yarn sensing detector WD, preferably of optical type, well-known per se to the man skilled in the art, is positioned at the arrival end AE of the shed WMS at a distance d from the woven fabric selvedge (=the arrival end AE of the shed). The position of the detector WD is adjustable in the length direction along the shed but is usually chosen so that d is approximately 50% of one yarn withdrawal revolution, i.e. the actual circumference of the storage drum of the yarn storing, feeding and measuring device MD.

When the weft yarn WY, during its insertion into the shed, reaches the position of the yarn sensing detector WD, said detector transmits a pulse signal over a signal wire $S_{WD}$ to a second electronic control unit B for the yarn storing, feeding and measuring device, which control unit will be described in detail below with reference to FIGS. 6 and 7. In response to the signal on wire $S_{WD}$, the control unit B transmits an actuation signal to a yarn stopping device positioned at the withdrawal end of the yarn storing, feeding and measuring device MD (see FIGs. 2–5) for stopping the withdrawal of the weft yarn WY from the device.

Figures 2, 3, 4, 5:
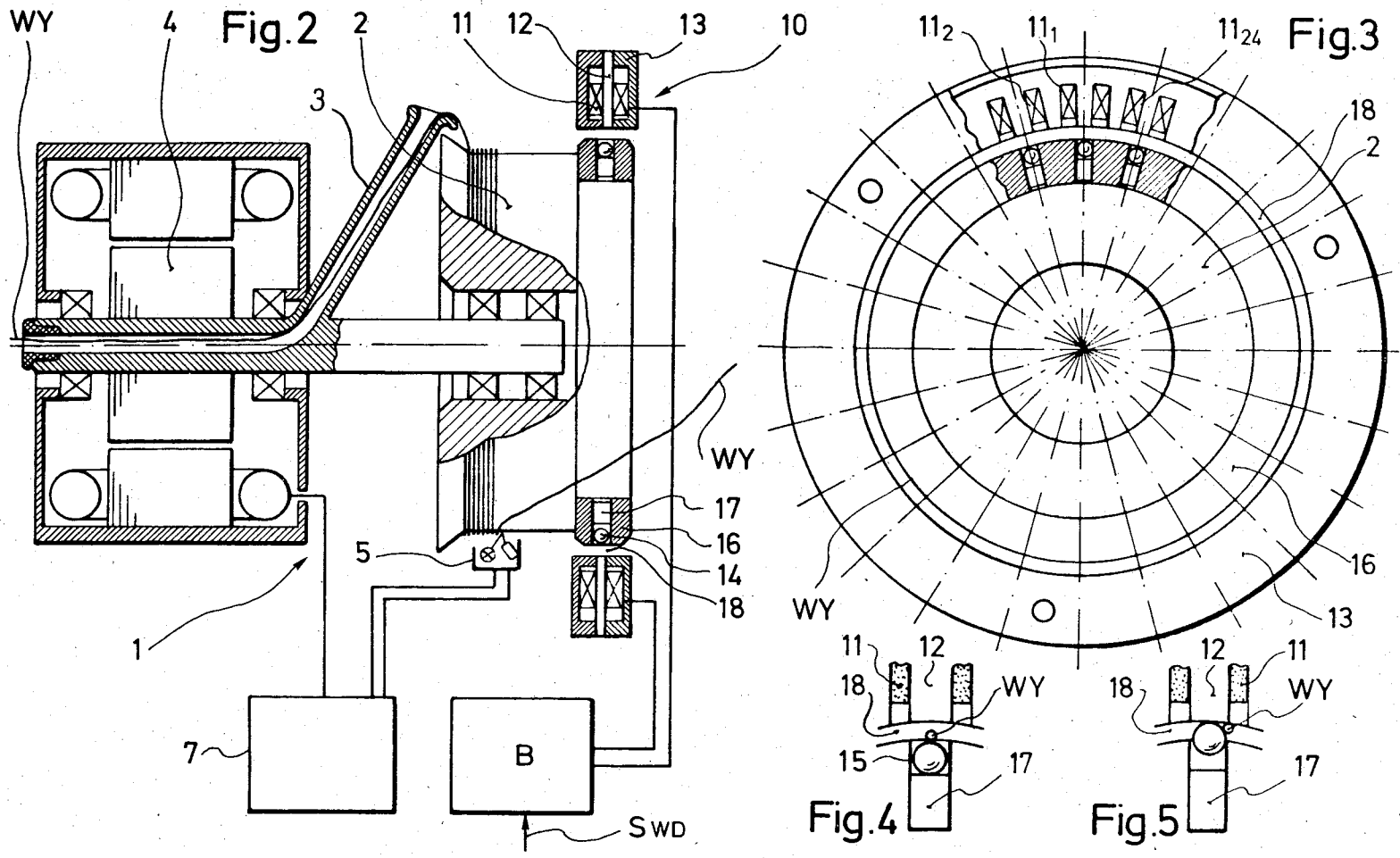
FIG. 2 shows a side view of the yarn storing, feeding and measuring device itself, in partially cut- and cross-sectional representation.
FIG. 3 shows a front view of the device as shown in FIG. 1.
FIGS. 4 and 5 show details of the device shown in FIGS. 1 and 2.

Referring now to FIG. 2, a yarn storing, feeding and measuring device 1 consists of a storage drum 2, a winding-on device in the form of an orbiting feeder tube 3 and an electric motor 4 for driving the winding-on device. A weft yarn WY being supplied from the yarn spool YS (see FIG. 1) to the orbiting feeder tube 3 driven by the motor 4 is wound onto the storage drum 2 and forms there an intermediate yarn store of several yarn windings. The storage drum 2 is here a stationary part being kept in the stationary position with respect to the surroundings by magnetic means (not shown here). Devices of this type are well-known to the man skilled in the art, for example by U.S. Pat. Nos. 3,776,480 and 3,843,153. The feeding device 1 is provided with a yarn store sensor 5, sensing the amount of yarn stored on the drum 2, which sensor is located close to the generally cylindrical surface of the storage drum 2. This store sensor 5 can be a so called maximum sensor preferably consisting of a light emitting device and a light receiving device. The yarn store sensor 5 generates a signal indicating the amount of yarn stored on the drum, i.e. in principle the number of turns of yarn wound onto the drum. Based on this signal, a store control unit 7 controls the operation of the electric motor 4 in such a way that there is continuously a sufficient amount of yarn available on the yarn storage drum 2. Yarn store control units are per se well-known in the art. This art can be examplified by DE-OS No. 29 08 743, FR-A No. 1 562 223 and U.S. Ser. No. 584,436 (Applicant's own).

A yarn stopping device 10 located at the withdrawal end of the storage drum 2 consists of an actuator means comprising a plurality of electromagnetic coils 11 being wound around a coil core 12 supported of a balloon limiting ring 13 consisting of two U-shaped rings covering said plurality of electromagnetic coils 11. Said balloon limiting ring 13 is fixedly secured to the stationary part of the storing device 1, for example to a base plate thereof. A ringshaped guiding portion 16 is connected to the withdrawal end of the storage drum 2. Said guiding portion 16 supports a plurality of yarn stopping elements, each of said yarn stopping elements consisting of a metal ball 14 being movably disposed in a radial bore 15 provided in the guiding portion 16.

As shown in FIGS. 4 and 5, the respective electromagnetic coils 11 and associated cores 12 are arranged opposite to said bores 15. The balloon limiting ring 13 and the guiding portion 16 define a gap 18 being preferably in the order of 1–2 millimeters. The weft yarn WY passes said gap when being withdrawn from the storage drum 2. A permanent magnet 17 is located at one end of each bore 15 for moving back said metal ball 14 into said bore 15 after switching off an actuation current fed to the respective electromagnetic coils 11. As shown in FIGS. 4 and 5, the metal ball 14 is attracted by the magnetic force of the coil 11 when switching on the actuation current fed to the coil 11. The width of the gap 18 corresponds to the radius of the metal ball 14. When the coil 11 is not actuated, the permanent magnet 17 will attract the metal ball 14, so that the ball will be completely positioned inside the bore 15, whereby the yarn WY can be freely withdrawn in the axial direction from the storage drum 2 and inserted into the shed of the weaving machine.

The magnetic force of each electromagnetic coil 11 is chosen such that this force will overcome the attraction force of the permanent magnet 17 when feeding the actuation current to the coil 11. The metal ball 14 will thereby move outwardly in the radial direction of the bore 15 and come into contact with the free end of the coil core 12. In this condition, approximately half the metal ball locks the gap 18 for the passage of the yarn WY in such a way that the withdrawal of the yarn from the storage drum 2 is terminated. When switching off the actuation current fed to the coil 11, the tension in the yarn WY, being pulled by the main air jet nozzle MN (see FIG. 1) into the shed of the weaving machine, co-acts with the magnetic force of the permanent magnet 17 such that the metal ball 14 will return to its starting position so as to come into contact with the permanent magnet 17. As the tension of the yarn co-acts with the magnetic force of the permanent magnet 17 due to the shape of the metal ball 14, the holding force of the permanent magnet 17 can be relatively low. Hence, only a small portion of the attracting force generated by the electromagnetic coil 11 is required for overcoming the magnetic force of the permanent magnet 17. For this reason, the yarn stopping device 10 is working faster than prior art devices using stopping elements which are needle- or pin-shaped. For further enhancing the operation of the yarn stopping device 10, a thin plate of non-magnetic material can be positioned at the outer end of the permanent magnet 17 and/or on the free end of the coil core 12 for eliminating a magnetic sticking or "adhesion" effect between the metal ball 14 and the permanent magnet 17 and/or the coil core 12.

The stopping element can also have the form of a short-cylindrical pin with a plane inner end directed to the permanent magnet 17 and a rounded, preferably semi-spherical outer end.

Figure 6:
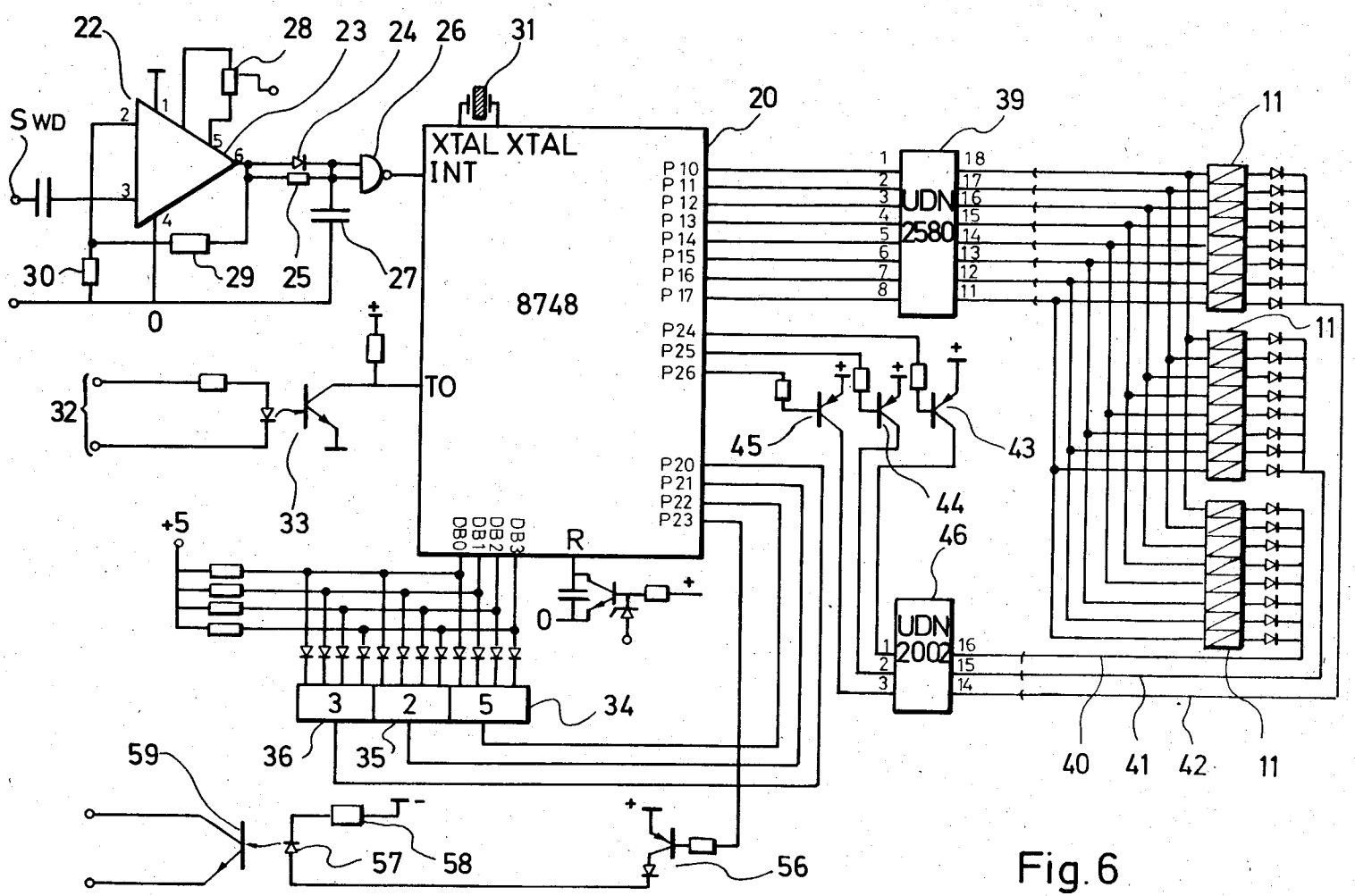
FIG. 6 shows a circuit diagram of an actuator control unit of the device shown in FIGS. 1–5.

Referring now to FIG. 6, the control unit B will be hereinafter described in detail. This unit B comprises a calculating means 20, which is a standard microprocessor, here of the type 8748, manufactured by the INTEL Corp., U.S.A. The microprocessor 20 is supplied with sync signals generated by a crystal resonator 31 connected to input pins XTAL of the microprocessor.

A trigg-input 32 receives a signal picked up at the main shaft of the weaving machine. This signal is applied to the input of an opto-electronical coupling element 33, the output of which being connected to pin T0 of the microprocessor. The trigg-signal serves to synchronize the operation of the loom with the operation of the microprocessor 20 controlling the yarn storing, feeding and measuring device 1. More particularly, the occurrence of a trigg-signal on input 32 indicates that the next weft yarn insertion cycle starts.

In the control unit B there is provided a weft yarn length setting switching device preferably consisting of three BCD switches 34–36, each of which having four input terminals and one output terminal. Each of the BCD switches can be set to a decimal number from 0–9. This decimal number is converted by the respective switch such that the corresponding one of its four input terminals is connected to its output terminal in accordance with the code. When for example setting one of the BCD switches to the decimal number 5, then its first and third input terminal is connected to its output terminal, whereas its second and fourth input terminal is disconnected from the output terminal. The respective first input terminals of the switches 34–36 are connected via diodes to input pin DB3 of the microprocessor 20, the respective second input terminals of the switches are connected via diodes to input pin DB2 of the microprocessor, the respective third input terminals of the switches are connected via diodes to input DB1 of the microprocessor and the respective fourth input terminals of the switches are connected via diodes to input DB0 of the microprocessor 20. The respective output terminals of the switches 34–36 are connected to output pins P22–P20 of the microprocessor 20. At the beginning, each of the input pins DB0–DB3 of the microprocessor is in its "high" state, i.e. at logical one potential. The pins P20–P22 of the microprocessor 20 are also in the "high" state. For reading the value of one of the switches 34–36, the microprocessor 20 pulls down the voltage of one of its pins P20–P22. For example, for reading the BCD value of switch 34, the microprocessor 20 sets its pin P22 to zero potential, i.e. to its "low" state. In case the decimal number selected on switch 34 manually by the weaving machine operator is "5", the voltage on pins DB3 and DB1 of the microprocessor 20 will be pulled down to zero potential, i.e. to the "low" logical state, whereas the logical state of pins DB2 and DB0 remain at "high" potential.

Output pins P10–P17 of the microprocessor 20 are connected to input pins 1–8 of an amplifier circuit 39, this amplifier or driver circuit having eight output terminal pins 11–18, each of these being associated to a respective input pin 1–8. When receiving an input signal of "high" potential (logical one) at its input pins 1–8, the driver circuit 39 connects the corresponding output terminal pin to a voltage source having a potential of −35 Volts. Each of the output pins 11–18 of the driver circuit 39 is connected to three electromagnetic coils 11. Twenty-four electromagnetic coils 11 associated to twenty-four yarn stopping devices 10 are arranged as a matrix having eight rows and three columns. The respective output terminals of the electromagnetic coils 11 arranged in one column are connected to a respective one of three output conductors 40–42.

Output pins P24–P26 of the microprocessor 20 are connected through current amplifiers 43–45 to input pins 1–3 of a further driver circuit 46. This driver circuit 46 includes three output pins 14–16, each of which being connected to a respective one of the conductors 40–42. When receiving a "high" potential (logical one) at one of its input pins, the driver circuit 46 connects the corresponding output pin to a voltage of +5 Volts. Due to the above described circuit matrix arrangement, the microprocessor 20 is enabled to energize one of the twenty-four electromagnetic coils 11 by generating a "high" potential at one of the output pins P10–P17 determining the row of the coil 11 to be actuated, and by generating a "high" potential at one of its output pins P24–P26 selecting the column of the electromagnetic coil 11 to be actuated. The above described matrix arrangement allows to actuate one electromagnetic coil 11 among the twenty-four electromagnetic coils 11 with only eleven output pins P10–P17 and P24–P26 and thus with only eleven wires.

Output pin P23 of the microprocessor 20 is connected via a current amplifier 56 to a light-emitting element 57, which in turn is connected to minus potential via a resistor 58. The light-emitting element 57 actuates an opto-sensitive switching element 59 actuating in turn a stop-motion relay (not shown here but well-known to the man skilled in the art) of the weaving machine.

The amplifier or driver circuits 39 and 46 are standard circuit elements of the type UDN 2580A respectively UCN 2002A, both circuits being available from the SPRAGUE Corp., U.S.A.

In this preferred embodiment of the invention, the signal wire $S_{WD}$ from the yarn sensing detector WD at the arrival end AE of the shed of the weaving machine is connected to input pin INT of the microprocessor 20 over a yarn sensor interface circuit 22. The yarn sensor interface circuit 22 essentially consists of an operational amplifier 23 connected through a diode 24 and a resistor 25 in parallel connection to an inverter gate 26, the output thereof being connected to input pin INT of the microprocessor 20. The input terminals of the inverter gate 26 are connected to ground via a capacitor 27. The gain of the operational amplifier 23 can be adjusted by a variable gain control resistor 28 connected to the operational amplifier 23. When a pulse is generated by the yarn sensor WD, it will be current-amplified by the operational amplifier 23. The output current of the operational amplifier 23 passes the diode 24 and charges the capacitor 27. When the pulse signal goes back to zero potential, the capacitor 27 is discharged through resistors 25, 29 and 30 to ground. Due to the switching threshold of the inverter gate 26, only pulses of a predetermined voltage are detected, so that the yarn sensor interface circuit 22 disregards small noise voltages. As the capacitor can be quickly charged through diode 24 and is only slowly discharged through resistors 25, 29 and 30, short input pulses are transformed to longer output pulses as generated by gate 26. Such a widening of the very short input pulses to the interface circuit enables the microprocessor 20 to reliably detect the input pulses, even if these pulses should be short.

Figure 7:
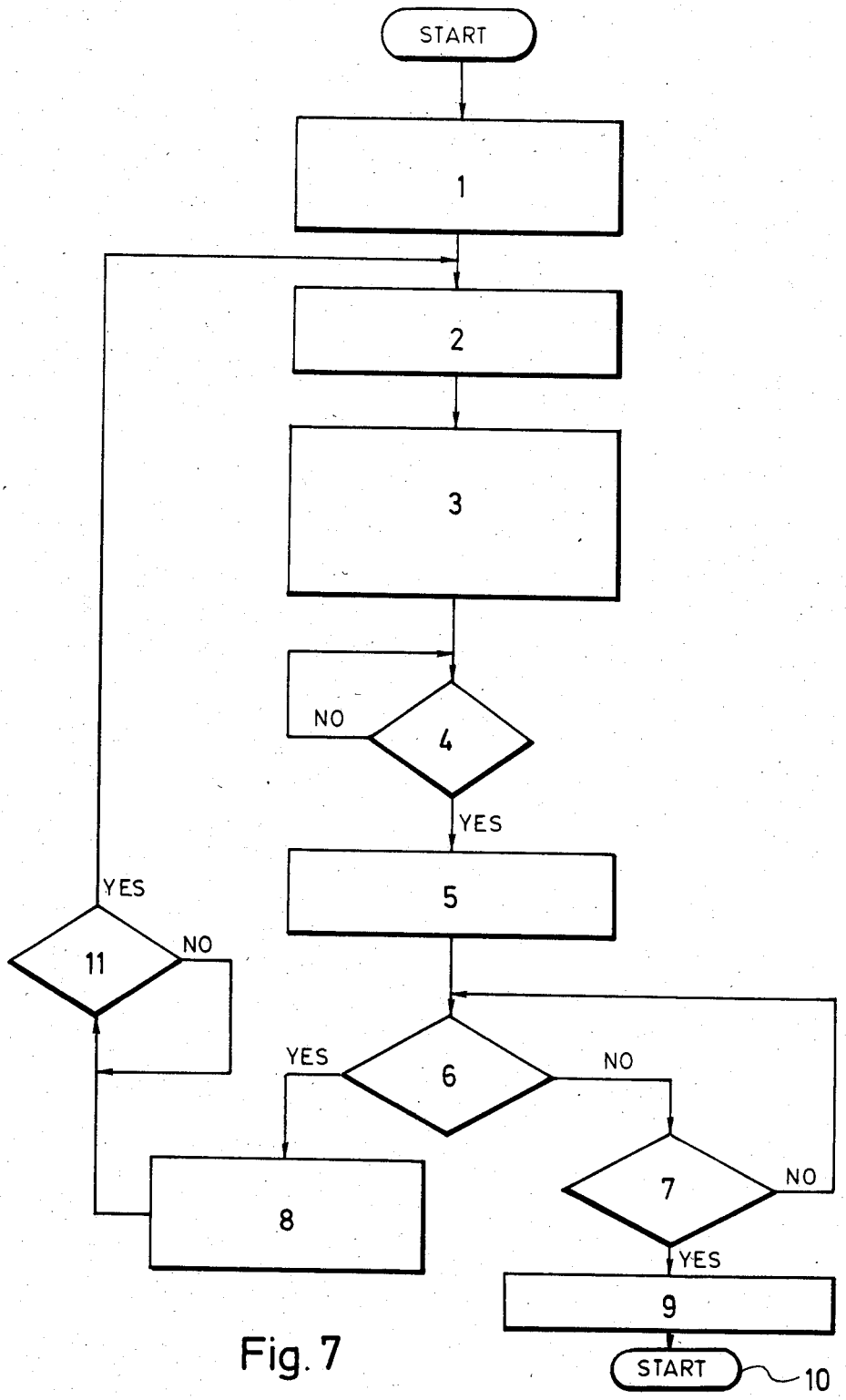
FIG. 7 shows a flow-diagram used in a microprocessor of the actuator control unit as shown in FIG. 6.

Referring now to FIG. 7, there is shown a flow diagram of the control programme stored in the read-only memore of the microprocessor 20. When receiving a reset signal on reset line 43, this signal will pass through a reset interface circuit 44 to the reset pin R of the microprocessor 20. This reset signal is automatically generated each time the main power of the weaving machine is switched on, which guarantees that the microprocessor begins to carry out the control programme with the first step after switching on the power of the machine. So, at this moment, the microprocessor 20 starts to carry out the first instruction called the "START" instruction.

At programme step No. 1, the microprocessor 20 actuates a predetermined yarn stopping device 10 for locking the weft yarn WY in its start of withdrawal position. The microprocessor 20 stores the number of the actuated stopping device or its angular position in a predetermined storage cell of its RAM (Random Accessary Memory).

At programme step No. 2, the microprocessor 20 consecutively reads the BCD code of the switches 34–36 representing the set desired weft yarn length (manually set by the weaving machine operator) and stores the corresponding BCD codes in predetermined storage cells of its RAM.

At programme step No. 3, the microprocessor 20 transfers the BCD codes representing the set desired weft yarn length to a digital value corresponding to the number of withdrawal revolutions and 1/24 revolutions of the storage drum 2, whereby this digital value represents the number of revolutions around the storage drum which the withdrawal point of the yarn travels during one weft yarn insertion cycle, i.e. during withdrawal of the desired weft yarn length. It would also be possible to express said desired weft yarn length by a value corresponding to the time required for withdrawing the desired weft yarn length. On the basis of said digital number, the microprocessor 20 determines which yarn stopping device shall be actuated next, i.e. by the end of the present withdrawal cycle. The number of the determined stopping device is stored in a predeterined storage cell of the RAM of the microprocessor 20.

At programme step No. 4 there is a waiting routine or loop, causing the microprocessor 20 to await the receipt of a trigg-signal from the weaving machine, e.g. in the form of a signal representing the actual position of the main shaft of the weaving machine at the moment when the present weft yarn insertion cycle shall start. This trigg-signal can be generated by a rotary sensor, per se well-known to the man skilled in the art, reading the angular position of the main shaft of the machine. This waiting routine is realized by a programme loop periodically checking whether the trigg-signal occurs. If this condition is fulfilled, the microprocessor 20 continues with the programme step No. 5.

At programme step No. 5, the yarn stopping device 10 actuated during programme step No. 1 is de-actuated for releasing the locked weft yarn WY.

Then, during the whole weft yarn insertion cycle, the microprocessor 20 carries out a waiting routine at step No. 6, by which the microprocessor awaits, by reading its input pin INT or periodically checks whether a signal is occurring or is received on signal wire $S_{WD}$ from the weft yarn sensing detector WD at the arrival end of the shed of the weaving machine. As long as this condition is not fulfilled, the microprocessor 20 continues to programme step No. 7. When the condition is fulfilled, it continues to programme step No. 8.

At programme step No. 7, there is a fault-checking routine for e.g. detecting the occurrence of a yarn breakage. This routine is realized by comparing the actual time lapsed since the release of the previously actuated yarn stopping device in programme step No. 5, which actual time is continuously calculated or measured internally in the microprocessor 20, with a predetermined time threshold, which is only exceeded in the case of e.g. a yarn breakage. As long as this condition is not fulfilled, the microprocessor 20 goes back to programme step No. 6 again. When the condition is fulfilled, the microprocessor continues to programme step No. 9.

At programme step No. 9, the microprocessor 20 generates a "high" potential signal (logical one) on its output pin P23, whereby the stop-motion relay of the weaving machine is actuated and the weaving machine is stopped.

At programme step No. 10, the microprocessor 20 goes back to the START instruction of the programme after having received a reset signal on its R (=Reset) input pin.

At programme step No. 8, the microprocessor 20 actuates the yarn stopping device as determined or selected during programme step No. 3 for stopping the yarn withdrawal from the storage drum 2. This is carried out by the microprocessor 20 generating a "high" potential (logical one) on the relevant output pin among P10–P17 and the relevant output pin among P22–P24, which lead to the selected stopping device in the matrix arrangement as shown in FIG. 6. Furthermore at programme step No. 8, the microprocessor 20 stores the number of the now actuated stopping device in a predetermined storage cell of its RAM.

At programme step No. 11, the microprocessor 20 checks if the trigg-signal as received at programme step No. 4 has disappeared in the meantime. As soon as the trigg-signal has disappeared, the microprocessor 20 goes back to programme step No. 2 and the whole chain of programme steps will be carried out by the microprocessor 20 again for controlling the subsequent weft yarn insertion cycle.

The present invention is not limited to the embodiment as described above and shown in the drawings but also other embodiments are possible within the scope of the present invention. For example, the utilization of the weft detector WD is not limited to the case where the yarn measuring device MD has a plurality of yarn stopping devices for the yarn withdrawal, but the weft detector WD and its function according to the invention can also be applied as a trigg-signal generating means for stopping the yarn withdrawal in a measuring device with only one yarn stopping device at the withdrawal end of the drum, where the adjustment of the desired weft yarn length is carried out by adjustment of the diameter (circumference) of the storage drum.

The embodiments of the invention in which an exclusive property or privilege is claimed are defined as follows:

1. Yarn storing, feeding and measuring device for jet weaving machines, comprising a storage drum onto which an intermediate weft yarn store can be wound by a winding-on member and from which the weft yarn is withdrawn spiralling around a withdrawal end of the storage drum, at least one yarn stopping device being arranged at said withdrawal end and including a stopping element and actuator means for moving said stopping element into and out of the path of the yarn being withdrawn, and an actuator control unit for transmitting an actuating signal to said stopping device when a weft yarn length corresponding to the length of the shed of the woven fabric in the machine has been withdrawn from the storage drum, said actuator control unit being electrically connected to a yarn sensing detector positioned adjacent the arrival end of the shed for the weft yarn at a predetermined distance from said arrival end, said control unit receiving an electric signal from said yarn sensing detector when the inserted weft yarn reaches said yarn sensing detector and, in response thereto, generating and transmitting said actuating signal to the actuator means of said yarn stopping device for stopping the withdrawal of the weft yarn from the storage drum, wherein said yarn sensing detector is displaceable in the length direction of the shed for adjusting the point in time when the control unit receives said electric signal representing the arrival of the inserted weft yarn at the arrival end of the shed.

2. A yarn storing, feeding and measuring device for jet weaving machines, including a storage drum onto which an intermediate weft yarn store can be wound by a winding-on member and from which the weft yarn can be withdrawn spiralling around the withdrawal end of the storage drum, at least one yarn stopping device and a control unit for transmitting an actuating signal to said stopping device when a weft yarn length corresponding to the length of a shed of the woven fabric in the machine has been withdrawn from the storage drum, comprising:

said control unit being electrically connected to a yarn sensing detector positioned adjacent the arrival end of the shed for the weft yarn at a predetermined distance from said arrival end; and said control unit transmitting the actuation signal to said yarn stopping device when it receives a signal from the yarn sensing detector representing the detection of the weft yarn;

wherein said yarn sensing detector is displaceable in the length direction of the shed for adjusting the point of time when the control unit receives said signal from the yarn sensing detector.

3. Method for controlling a yarn storing, feeding and measuring device for a jet weaving machine having a shed, said device including a storage drum onto which an intermediate weft yarn store can be wound by a winding-on member and from which the weft yarn can be withdrawn spiralling around the withdrawal end of the storage drum, and at least one yarn stopping device, comprising the steps of releasing said yarn stopping device at the beginning of a yarn withdrawal cycle, monitoring the arrival of the weft yarn at a predetermined distance from the arrival end of the shed, and actuating said yarn stopping device in response to detection of the arrival of the weft yarn; and including the steps of measuring the period of time from the releasing of said yarn stopping device, comparing the momentary measured period of time to a threshold value, terminating said time measurement as soon as the arrival of the weft yarn is detected, and generating a fault signal as soon as said momentary measured period of time exceeds said threshold value.

* * * * *